United States Patent [19]

Mueller et al.

[11] 4,352,079

[45] Sep. 28, 1982

[54] HIGH VOLTAGE IGNITION TRANSFORMER

[75] Inventors: Dale A. Mueller, St. Paul; Timothy P. Sperry, New Brighton, both of Minn.

[73] Assignee: Honeywell Inc., Minneapolis, Minn.

[21] Appl. No.: 286,407

[22] Filed: Jul. 24, 1981

[51] Int. Cl.[3] ..... H01F 15/02; H01F 15/10; H01F 27/30

[52] U.S. Cl. ..... 336/65; 336/92; 336/107; 336/192; 336/198

[58] Field of Search ..... 336/65, 90, 92, 192, 336/198, 208, 185, 105, 107, 83, 136

[56] References Cited

U.S. PATENT DOCUMENTS

| | | | |
|---|---|---|---|
| 488,951 | 12/1892 | Ries | 336/107 |
| 1,223,947 | 4/1917 | Ferrell | 336/198 X |
| 1,339,100 | 5/1920 | Cavanagh | 336/107 |
| 1,657,002 | 1/1928 | Cragg | 336/107 X |
| 1,873,122 | 8/1932 | Hartzell | 336/192 |
| 2,461,098 | 2/1949 | Weatherly | 336/198 X |
| 2,621,324 | 12/1952 | Pan | 336/136 |
| 2,949,591 | 8/1960 | Craige | 336/83 |
| 3,428,929 | 2/1969 | Brown et al. | 336/198 X |
| 3,546,647 | 12/1970 | Roddy et al. | 336/92 |
| 3,648,209 | 3/1972 | Conger | 336/198 X |
| 3,661,342 | 5/1972 | Sears | 336/198 X |
| 3,787,792 | 1/1974 | DeJong et al. | 336/192 |

FOREIGN PATENT DOCUMENTS

| | | | |
|---|---|---|---|
| 525936 | 10/1954 | Belgium | 336/208 |

*Primary Examiner*—Thomas J. Kozma
*Attorney, Agent, or Firm*—Alfred N. Feldman

[57] ABSTRACT

A high voltage transformer is formed by a unitary core mounting a primary winding being inserted in a cavity of a bobbin that mounts the secondary winding. The secondary winding is placed in alternate bays of a multibay structure to isolate the windings from one another to avoid high potential breakdown. The assembly is complete by the mounting of the core within the cavity of the bobbin, but can be supplemented by covering the entire unit with a protective housing that further aids in mounting the transformer to an insulating surface, such as a printed wiring board.

10 Claims, 9 Drawing Figures

FIG. 5
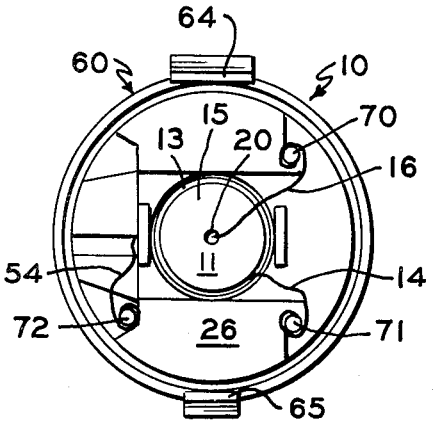
FIG. 4
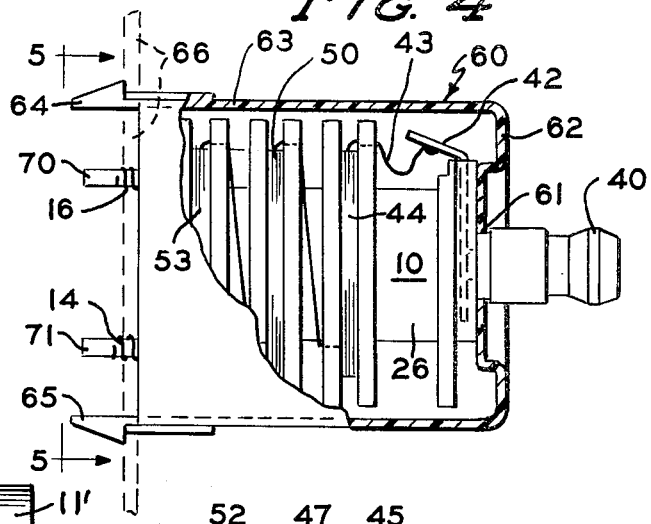
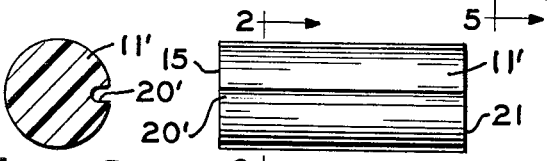
FIG. 2
FIG. 3
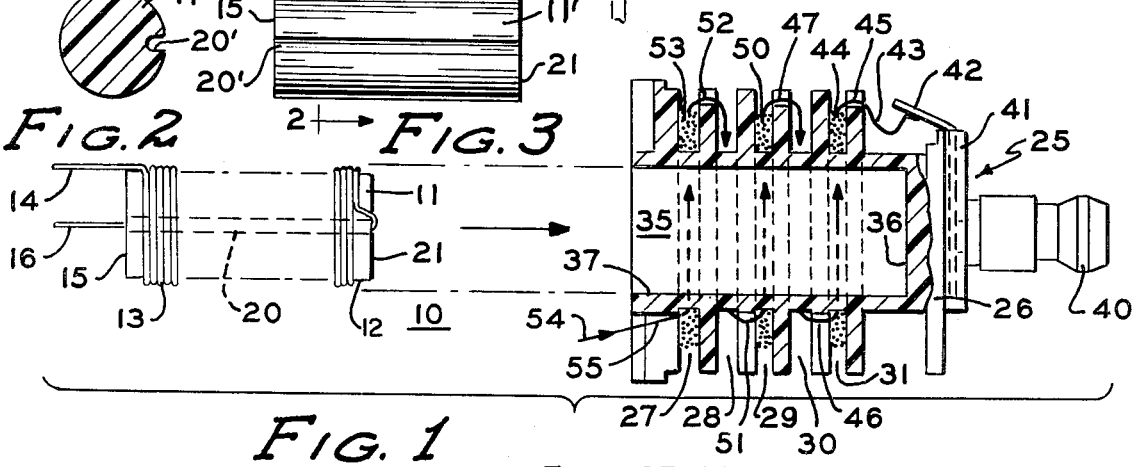
FIG. 1
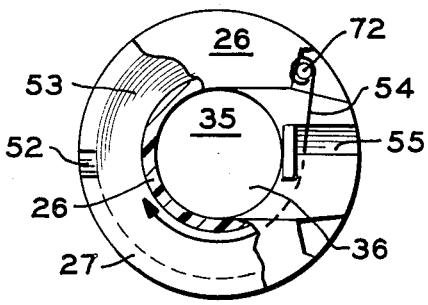
FIG. 7
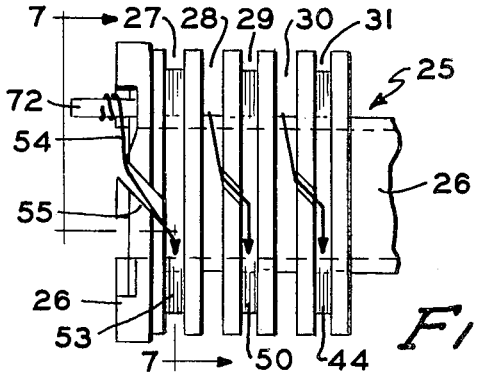
FIG. 6
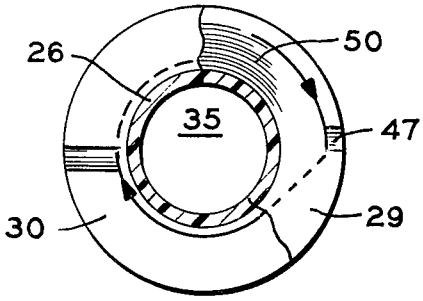
FIG. 9
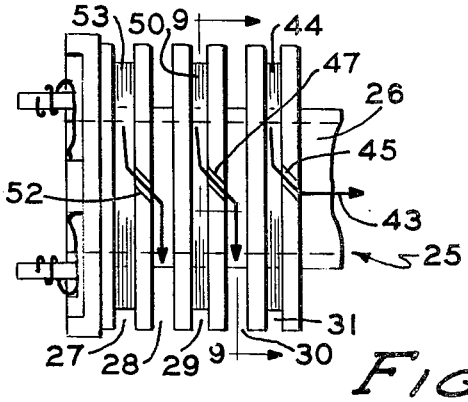
FIG. 8

HIGH VOLTAGE IGNITION TRANSFORMER

BACKGROUND OF THE INVENTION

High voltage ignition coils have been in use in various types of applications for many years. Typically, a high voltage type transformer is fabricated by winding a primary winding on a bobbin and winding a secondary winding on a portion of the same bobbin. The winding forms or bobbins are then interlinked by magnetic members and the entire device is encased in a potting material that insulates the various potentials. This type of structure is expensive, heavy, and is erratic in its reliability due to possible voids in the potting or insulating material that is used to isolate the high voltage windings.

In recent years, a relatively new application for high voltage ignition transformers has evolved. This application is the use of a high voltage spark ignition type transformer as a spark ignition source for fuel gas in fuel burners, such as gas furnaces. The need for ignition sources in this type of an environment has been dictated by an increase in cost of fuel, and by legislation. The past practice in fuel ignition systems for furnaces has been to rely on a standing pilot flame that is monitored by a thermocouple or similar safety device as the ignition source for the main burner. This type of standing pilot configuration is very reliable and inexpensive to construct, but this structure utilizes fuel gas constantly. As such, the use of gas is considered inappropriate due to the shortage of gas and its accelerating cost. This pair of factors has lead to the legislation of standing pilot configurations out of existence in many states. To replace the standing pilot, a number of fuel burner or furnace manufacturers have begun to rely on a spark ignition system that provides an ignition spark at a pilot burner to ignite the pilot burner. The pilot burner is then monitored by a flame rod or other technique to ensure that the pilot flame exists. That pilot flame is then used to ignite a main burner. This type of equipment must be reliable, it must be inexpensive, and it must be small. The present state of the art utilizes a high voltage ignition transformer, and these transformers have been more expensive and less reliable than is desirable.

SUMMARY OF THE INVENTION

The present invention is directed to a new type of ignition transformer that is suitable for generating the high voltage necessary for spark ignition of fuels such as natural gas in a furnace. These types of ignition transformers typically operate with a relatively low voltage on their primary and with approximately a 15,000 volt output for generation of a spark at the burner. The present invention utilizes a structure that is relatively inexpensive, and which requires no potting for protection of the high voltage windings from either the low voltage windings or the other portions of the high voltage windings. The present invention utilizes a primary winding that is placed on a solid ferrite magnetic core that is inserted within a cavity of a winding bobbin for the high voltage windings of the transformer. The high voltage windings are separated into a number of bays so that a number of active winding sections can be provided that are separated by empty bays that act as voltage spacers. This assembly is inexpensive to build in that the primary winding can be readily wound as a separate element and then simply inserted into the cavity formed in the center of the secondary winding bobbin. This entire arrangement can then be covered with a molded housing that allows for the assembly of the pieces on an insulated mounting surface, such as a printed wiring board. This assembly is reliable, inexpensive, and does not entail potting of the transformer to isolate the high voltage generated in the secondary windings from either the initial windings of the secondary windings or from the primary windings of the transformer.

BRIEF DESCRIPTION OF THE DRAWINGS

FIG. 1 is an exploded view of the primary and secondary portions of the transformer;

FIGS. 2 and 3 are an end view and an elevation of an alternate primary core;

FIG. 4 is a cut away drawing of an assembled transformer;

FIG. 5 is an end view of FIG. 4 taken along lines 5—5;

FIG. 6 is a partial elevation of the winding portion of the secondary of the transformer;

FIG. 7 is an elevation of the end of FIG. 6;

FIG. 8 is a further elevation of the winding form of the secondary winding, and;

FIG. 9 is a section taken through FIG. 8.

DESCRIPTION OF THE PREFERRED EMBODIMENT

In FIG. 1, an exploded view of the high voltage transformer 10 is disclosed. In this exploded view, a core 11 is formed of a magnetic material that has a coil winding surface 12 upon which a primary winding 13 is placed. The primary winding 13 has an initial end 14 that projects from a mounting end 15 of the core 11. A second end of the winding 13 is disclosed at 16, and it is placed in a recess or hole 20 that leads from the mounting end 15 to a confined end 21 of the winding core 11. By this means, the winding 13 can be placed on the core 11 so that the end 16 is out of contact with the winding 13, but projects at the mounting end 15 along with a first end 14. This provides that both ends of the primary winding 13 are available for connection in a manner that will be described.

The transformer 10 has a second portion disclosed at 25 that is wound on an insulating bobbin 26. The bobbin 26 is molded of an insulating material and has a plurality of bays 27, 28, 29, 30, and 31. The bays 27 through 31 are a plurality of winding and spacing bays that are molded in a spaced relationship from one another and are generally parallel to each other. The bobbin 26 has molded in its center a cavity disclosed at 35 with the cavity having a closed end 36 and an open end 37. The cavity 35 is designed to receive the core 11 with the winding 13 in place. The fit of the core 11 with the winding 13 is such that the core and winding can be readily placed in the cavity 35 during the assembly of the transformer means 10.

Mounted on the closed end 36 of the cavity 35 is a high voltage terminal 40 that is rigidly fixed at 41 within the closed end 36 of the bobbin 26. The terminal 40 has a projection 42 that is connected to a lead or end 43 of a winding 44 that forms part of the high voltage or secondary winding of the transformer means 10. The end 43 passes through a slot 45 in the bobbin 26 so that the end 43 communicates with a winding portion 44 that forms one third of the high voltage or secondary winding for the transformer 10. The winding portion 44 is placed in the bay 31. Immediately adjacent the bay 31 is the bay 30 which is left free of windings except the lead 46 which passes through a slot 47 where the winding portion 44 is continued to the bay 29 and a second winding portion 50 for the secondary of the transformer 10. The winding portion 50 is in the bay 29, and it in turn is connected by a conductor 51 in the bay 28 to a slot 52 to the final winding portion 53 of the secondary winding. The final portion 53 is in bay 27 where a lead in conductor 54 is provided so that continuity can be provided between the lead in wire 54 and the conductor 43 so that it can be connected to the terminal 42. Each of the winding portions 53, 50, and 44 make up a continuous secondary winding for the transformer 10 with the winding portions separated into winding bays that provide electrical insulation for the individual winding portions.

It will be understood in FIG. 1 that when the winding form or core 11, with the primary winding 13 is inserted in the cavity 35, that a magnetic coupling is provided between the primary winding 13 and the secondary winding of the transformer is provided. A high voltage is generated between the terminal 40 and the lead in wire 54 when power is supplied to the primary winding 13 between the conductors 14 and 16.

In FIG. 1 the core 11 is disclosed as having an opening or hole 20 that interconnects the mounting end 15 and the confined end 21 of the core 11. In FIGS. 2 and 3 another core configuration 11' is disclosed. The cross section in FIG. 2 discloses that the recess 20 of FIG. 1 is replaced by a recess 20' that passes from the mounting end 15 to the confined end 21. In the configuration of core disclosed in FIGS. 2 and 3, the second winding end 16 of the transformer primary 13 would lay in the recess 20' as opposed to being placed in a central hole 20 as disclosed in FIG. 1. The term "recess" has been used for both the hole 20 and the recess 20'. The only requirement of the recess in the cores 11 or 11' is that the second winding end 16 be isolated below the surface of the primary winding 13 so as to avoid any electrical shorting of the turns after the device has been wound.

In FIGS. 4 and 5, a complete, assembled transformer 10 is disclosed with FIG. 4 disclosing a cut away section of the transformer 10 in an assembled relationship with a cover 60 that is placed over the transformer 10. The cover 60 has an opening 61 that passes over the terminal 40. The cover 60 further has an enclosing end 62, along with a cylindrical wall 63 that encircles and encloses the transformer 10. The housing 10 further has two projections 64 and 65 that are shown adapted to be mounted through an insulating surface 66. The insulating surface typically would be a printed wiring board through which the projections 64 and 65 have been placed and which are allowed to expand due to the natural resilience of the molded plastic housing 60 to lock the transformer 10 into the printed wiring board 66. It should be noted that the use of the molded housing 60, and the projections 64 and 65 are strictly optional as the transformer could be mounted on an insulating surface, such as a printed wiring board 66, by connecting the transformer 10 in a manner that will be described in connection with FIG. 5.

In FIG. 5 a bottom view of the entire device in FIG. 4 is disclosed. In addition to the mounting technique previously described, a group of terminals 70, 71, and 72 are disclosed. The terminals 70, 71, and 72 are molded into the bobbin 26, or are attached to the bobbin 26 after it has been molded, and act as terminals for the conductors 14, 16, and 54 which were disclosed in FIG. 1. The conductors 14, 16, and 54 are brought out to the terminals 70, 71, and 72 and wrapped into electrical contact with the terminals. The terminals then project, as can be seen in FIG. 4, through the printed wiring board 66. These terminals allow for the soldering of the terminals 70, 71, and 72 to a circuit on the printed wiring board 66 or to any other convenient electrical circuit. The connection of the lead out wires 14, 16, and 54 to the terminals 70, 71, and 72 also lock the core 11 into the cavity 35 of the molded bobbin 26 to hold the transformer in an assembled relationship. This assembled relationship is reinforced and protected by the use of the molded plastic housing 60. The molded plastic housing 60 is an optional item, and it does aid in the assembly and maintenance of the transformer into an assembled unit, if desired.

In FIGS. 6 through 9 additional details of the winding structure of the transformer secondary winding or high voltage winding is disclosed. The numbers in FIGS. 6 through 9 correspond with the numbers used in FIGS. 1 through 5. Only a brief mention of this structure will be provided as it is believed that the drawings are generally self-explanatory. In FIGS. 6 through 9 partial views of the molded bobbin 26 and the secondary winding of the transformer 10 are disclosed. The views at FIGS. 6 through 9 disclose how the winding progresses from the terminal 72 in the bobbin 26 through a slot 55 to the first bay 27 where the winding portion 53 is provided. The lead or wire 54 is disclosed as passing through the bay 28 which is left unused as a means of insulating the winding portion 53 from the winding portion 50 in bay 29. This procedure again follows wherein the bay 30 is left open and the winding portion 44 in the bay 31 is disclosed.

In FIG. 8 the opposite side of the bobbin 26 is disclosed and again the winding bays 27 through 31 are noted. The slots 52, 47, and 45 are disclosed to show the path of the secondary winding of the bobbin 26. The winding terminates in conductor 43 that is connected to the terminal 42 (of FIG. 1).

FIG. 7 discloses a cut away portion of the first winding bay 27 and its interrelationship to the slot 55 and the terminal 72 showing how the lead 54 connects to the terminal 72 and then is lead into the first winding bay 27 where the first winding portion 53 is wound on a bobbin 26. In FIG. 9 a section taken along line 9—9 of FIG. 8 shows the progression of the secondary winding in the winding bays of the bobbin 26.

The present invention allows for the fabrication of an inexpensive, high voltage type of transformer that can be used for spark ignition and other purposes and which is susceptible of being mounted on any type of an insulating surface. The transformer can be formed of just the core and bobbin along with their appropriate windings, or can be further modified by the addition of the housing 60 to protect the unit and aid its mounting. Also, the core configuration or the winding of the primary winding for the transformer 10 can be varied according to the above description, and by other techniques that would be obvious to those skilled in the art. For these reasons, the total concept of the present spark ignition type of high voltage transformer, and the scope of the present invention is defined solely by the scope of the appended claims.

The embodiments of the invention in which an exclusive property or right is claimed are defined as follows:

1. A high voltage ignition transformer which is adapted to be mounted upon an insulating surface, including: a core formed of a magnetic material having a coil winding surface, a mounting end, a confined end, and a recess with said recess formed generally coaxial with said coil winding surface between said ends; a primary winding provided upon said winding surface with said primary winding have two winding ends; a first winding end projecting at said core mounting end, and a second winding end placed in said recess to lead said primary winding from said core confined end to said core mounting end to allow connection to both ends of said primary winding at said core mounting end while causing said second winding end to be spaced from said primary winding; a bobbin formed of an insulating material having a plurality of bays in spaced relationship to one another; said bobbin including a cavity within said bobbin with said bobbin cavity having an open end and a closed end; said cavity receiving and enclosing said core and said primary winding by said core and said primary winding being placed in said cavity through said open end of said bobbin; and a secondary winding for said high voltage transformer being wound on said bobbin with said secondary winding being placed in alternate bays of said bobbin to insulate said alternate bays of said secondary winding from each other.

2. A high voltage ignition transformer as described in claim 1 wherein said bays are generally parallel to each other; and said bobbin cavity is coaxial to said bobbin.

3. A high voltage ignition transformer as described in claim 2 wherein said recess in said core is a hole formed from said mounting end to said confined end.

4. A high voltage ignition transformer as described in claim 2 wherein said recess in said core is a groove-like recess in said winding surface from said mounting end to said confined end.

5. A high voltage ignition transformer as described in claim 3 wherein said ignition transformer further includes an insulated housing enclosing said bobbin with said housing protecting said secondary winding; said housing further including mounting means projection from said housing at said open end of said bobbin cavity; said mounting means adapted to project through said insulating surface to aid in mounting said transformer with said winding core in said bobbin cavity.

6. A high voltage ignition transformer as described in claim 4 wherein said ignition transformer further includes an insulated housing enclosing said bobbin with said housing protecting said secondary winding; said housing further including mounting means projection from said housing at said open end of said bobbin cavity; said mounting means adapted to project through said insulating surface to aid in mounting said transformer with said winding core in said bobbin cavity.

7. A high voltage ignition transformer as described in claim 5 wherein said bobbin includes a high voltage terminal exposed through said housing with said terminal mounted upon said bobbin; said terminal connected to an end of said secondary winding to provide a high voltage output point for said transformer and said terminal aiding in aligning said housing upon said bobbin.

8. A high voltage ignition transformer as described in claim 6 wherein said bobbin includes a high voltage terminal exposed through said housing with said terminal mounted upon said bobbin; said terminal connected to one end of said secondary winding to provide a high voltage output point for said transformer and said terminal aiding in aligning said housing upon said bobbin.

9. A high voltage ignition transformer as described in claim 7 wherein said magnetic core is a core formed of a unitary ferrite material.

10. A high voltage ignition transformer as described in claim 8 wherein said magnetic core is a core formed of a unitary ferrite material.

* * * * *